US010736482B2

(12) United States Patent
Oliveira

(10) Patent No.: US 10,736,482 B2
(45) Date of Patent: Aug. 11, 2020

(54) CARTON WITH ARTICLE ENGAGEMENT FEATURES

(71) Applicant: Graphic Packaging International, Inc., Atlanta, GA (US)

(72) Inventor: Steven M. Oliveira, Canton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 269 days.

(21) Appl. No.: 15/719,801

(22) Filed: Sep. 29, 2017

(65) Prior Publication Data

US 2018/0092503 A1 Apr. 5, 2018

Related U.S. Application Data

(60) Provisional application No. 62/402,320, filed on Sep. 30, 2016, provisional application No. 62/402,331,
(Continued)

(51) Int. Cl.

| | |
|---|---|
| ***A47L 13/51*** | (2006.01) |
| ***B65D 5/16*** | (2006.01) |
| ***B65D 5/10*** | (2006.01) |
| ***B65B 43/10*** | (2006.01) |
| ***B65B 5/04*** | (2006.01) |
| ***B65B 7/20*** | (2006.01) |
| ***B65D 5/54*** | (2006.01) |

(Continued)

(52) U.S. Cl.

CPC ..... *A47L 13/51* (2013.01); *A47L 13/38* (2013.01); *A47L 13/50* (2013.01); *B65B 5/04* (2013.01); *B65B 7/20* (2013.01); *B65B 43/10* (2013.01); *B65D 5/0227* (2013.01); *B65D 5/106* (2013.01); *B65D 5/16* (2013.01); *B65D 5/542* (2013.01); *B65D 5/705* (2013.01); *B65D 25/02* (2013.01); *B65D 77/10* (2013.01); *B65D 85/07* (2018.01); *A47L 13/16* (2013.01)

(58) Field of Classification Search

CPC ..... B65D 85/07; B65D 5/04; B65D 5/0227; B65D 5/106; B65D 5/16; B65D 5/542; B65D 5/705; B65D 7/20; B65D 77/10; B65D 43/10; B65D 25/02

See application file for complete search history.

(56) References Cited

U.S. PATENT DOCUMENTS

| | | | |
|---|---|---|---|
| 978,569 | A | 12/1910 | Elkin |
| 1,651,848 | A | 12/1927 | Stevens |

(Continued)

FOREIGN PATENT DOCUMENTS

| | | |
|---|---|---|
| DE | 196 42 571 | 5/1997 |
| DE | 203 17 334 | 2/2004 |

(Continued)

*Primary Examiner* — Corey N Skurdal

(74) *Attorney, Agent, or Firm* — Womble Bond Dickinson (US) LLP

(57) ABSTRACT

A carton for holding at least one article. The carton has a plurality of panels that extends at least partially around an interior of the carton. A plurality of end flaps are respectively foldably connected to a respective panel of the plurality of panels for closing an end of the carton. An engagement structure is attached to at least one panel of the plurality of panels. The engagement structure is positioned for receiving the at least one article and activating the at least one article.

40 Claims, 7 Drawing Sheets

Related U.S. Application Data filed on Sep. 30, 2016, provisional application No. 62/402,332, filed on Sep. 30, 2016.

(51) Int. Cl.

| | |
|---|---|
| ***A47L 13/50*** | (2006.01) |
| ***A47L 13/38*** | (2006.01) |
| ***B65D 85/07*** | (2017.01) |
| ***B65D 5/02*** | (2006.01) |
| ***B65D 5/70*** | (2006.01) |
| ***B65D 25/02*** | (2006.01) |
| ***B65D 77/10*** | (2006.01) |
| *A47L 13/16* | (2006.01) |

(56) References Cited

U.S. PATENT DOCUMENTS

| | | | | |
|---|---|---|---|---|
| 1,667,376 | A | 4/1928 | Fehrenkamp | |
| 1,824,862 | A | 9/1931 | Young | |
| D115,651 | S | 7/1939 | Ford et al. | |
| D120,673 | S | 5/1940 | Jung | |
| 2,312,595 | A | 3/1943 | Smith | |
| 2,348,378 | A | 5/1944 | Goodyear | |
| 2,363,861 | A | 11/1944 | Goodyear | |
| 2,565,146 | A | 8/1951 | Okon | |
| 2,586,301 | A | 2/1952 | Castle | |
| 2,737,326 | A | 3/1956 | Toensmeier | |
| 2,764,284 | A | 9/1956 | Arneson | |
| 2,794,585 | A | 6/1957 | Wagner | |
| 2,950,041 | A | 8/1960 | Stone | |
| 2,967,610 | A | 1/1961 | Ebert et al. | |
| 3,013,710 | A | 12/1961 | Kronson et al. | |
| 3,107,039 | A | 10/1963 | Painter | |
| 3,245,711 | A | 4/1966 | Dantoin | |
| 3,257,027 | A | 6/1966 | Weiss | |
| 3,493,261 | A | 2/1970 | Stout et al. | |
| 3,612,266 | A | 10/1971 | Graser | |
| 3,640,380 | A | 2/1972 | Huffman | |
| 3,722,945 | A | 3/1973 | Wood | |
| 3,767,041 | A | 10/1973 | Graser | |
| D242,901 | S | 1/1977 | Lohrbach | |
| 4,007,869 | A | 2/1977 | Stolkin et al. | |
| 4,008,849 | A | 2/1977 | Baber | |
| 4,039,120 | A | 8/1977 | Herzog | |
| 4,131,198 | A | 12/1978 | Fischer | |
| 4,164,286 | A | 8/1979 | Sutherland | |
| 4,188,766 | A | 2/1980 | Culpepper | |
| 4,192,540 | A | 3/1980 | Oliff | |
| 4,238,069 | A | 12/1980 | Morris, Jr. | |
| 4,326,628 | A | 4/1982 | Wood | |
| 4,336,898 | A | 6/1982 | Joyce | |
| 4,397,393 | A | 8/1983 | Pergande et al. | |
| 4,432,579 | A | 2/1984 | Denmark et al. | |
| 4,438,843 | A | 3/1984 | Graser | |
| 4,489,880 | A | 12/1984 | Calvert | |
| 4,530,459 | A | 7/1985 | Maroszek | |
| 4,566,591 | A | 1/1986 | Turtschan et al. | |
| 4,601,390 | A | 7/1986 | Rosenthal et al. | |
| 4,703,847 | A | 11/1987 | Oliff | |
| 4,815,609 | A | 3/1989 | Kiedaisch | |
| 4,993,625 | A | 2/1991 | Stease et al. | |
| D319,388 | S | 8/1991 | McIntosh, Jr. et al. | |
| 5,135,104 | A | 8/1992 | Jorba | |
| 5,188,225 | A | 2/1993 | Jorba | |
| 5,299,734 | A | 4/1994 | Lane | |
| 5,323,895 | A | 6/1994 | Sutherland et al. | |
| 5,325,992 | A * | 7/1994 | Koller | A47F 13/085 221/33 |
| 5,351,815 | A | 10/1994 | Fogle et al. | |
| 5,400,901 | A | 3/1995 | Harrelson | |
| 5,402,931 | A | 4/1995 | Gulliver et al. | |
| 5,407,065 | A | 4/1995 | Sutherland | |
| 5,439,112 | A | 8/1995 | De Guglielmo et al. | |
| 5,445,262 | A | 8/1995 | Sutherland | |
| 5,484,059 | A | 1/1996 | Sutherland | |
| 5,501,335 | A | 3/1996 | Harris | |
| 5,503,267 | A | 4/1996 | Sutherland | |
| 5,524,814 | A | 6/1996 | Davis | |
| D373,079 | S | 8/1996 | Fahlen | |
| 5,551,556 | A | 9/1996 | Sutherland | |
| 5,582,345 | A | 12/1996 | Lankhuijzen | |
| 5,588,586 | A | 12/1996 | Negelen | |
| 5,595,291 | A | 1/1997 | Negelen | |
| 5,598,920 | A | 2/1997 | Hansen | |
| 5,620,094 | A | 4/1997 | Naumann | |
| 5,622,281 | A * | 4/1997 | Annand | A47K 10/24 206/494 |
| 5,638,956 | A | 6/1997 | Sutherland | |
| D386,680 | S | 11/1997 | Johnson | |
| 5,687,838 | A | 11/1997 | Bakx | |
| 5,704,483 | A | 1/1998 | Groh | |
| 5,845,776 | A | 12/1998 | Galbierz et al. | |
| 5,921,392 | A | 7/1999 | Davis | |
| 5,950,912 | A | 9/1999 | Economopoulos | |
| 5,957,289 | A | 9/1999 | Negelen | |
| 5,960,945 | A | 10/1999 | Sutherland | |
| 5,984,086 | A | 11/1999 | Foushee et al. | |
| 6,021,897 | A | 2/2000 | Sutherland | |
| 6,059,182 | A * | 5/2000 | Wein | B65D 5/742 229/217 |
| 6,223,892 | B1 | 5/2001 | Bakx | |
| 6,315,111 | B1 | 11/2001 | Sutherland | |
| 6,349,849 | B1 * | 2/2002 | Pehr | A47K 10/421 221/33 |
| 6,439,452 | B1 | 8/2002 | Tsao | |
| 6,488,322 | B2 | 12/2002 | Bakx | |
| 6,530,516 | B1 | 3/2003 | Ritter | |
| 6,550,639 | B2 * | 4/2003 | Brown | A47L 13/40 15/1.52 |
| 6,615,984 | B2 | 9/2003 | Saulas et al. | |
| 6,817,484 | B2 * | 11/2004 | Morin | B65D 83/0894 221/48 |
| 6,866,189 | B2 | 3/2005 | Nelson | |
| D525,866 | S | 8/2006 | Oliveira | |
| 7,083,046 | B2 | 8/2006 | Bakx | |
| D532,690 | S | 11/2006 | Oliveira | |
| 7,159,760 | B2 | 1/2007 | Pluck et al. | |
| 7,264,114 | B2 | 9/2007 | Daniel | |
| 7,617,969 | B2 | 11/2009 | Oliveira | |
| 7,621,439 | B2 | 11/2009 | McClure | |
| 7,699,214 | B2 * | 4/2010 | Mestre | B65D 5/606 206/233 |
| 7,762,450 | B2 | 7/2010 | Oliveira | |
| 7,793,821 | B2 | 9/2010 | Oliveira | |
| 7,803,726 | B2 | 9/2010 | Policicchio et al. | |
| 8,162,135 | B2 | 4/2012 | Oliveira | |
| 8,225,985 | B2 | 7/2012 | Oliveira | |
| 8,978,889 | B2 | 3/2015 | Fitzwater et al. | |
| 9,265,386 | B2 * | 2/2016 | Granger | A47K 10/424 |
| 9,487,340 | B2 * | 11/2016 | Castela | B65D 83/0805 |
| 9,533,822 | B2 | 1/2017 | Policicchio | |
| 9,598,202 | B2 | 3/2017 | Oliveira et al. | |
| 9,630,736 | B2 | 4/2017 | Oliveira | |
| 9,840,358 | B2 | 12/2017 | Oliveira | |
| 10,220,997 | B2 * | 3/2019 | Oakes | B65D 75/42 |
| 2002/0113449 | A1 | 8/2002 | Bakx | |
| 2003/0106926 | A1 | 6/2003 | Beatificato et al. | |
| 2003/0155264 | A1 * | 8/2003 | Morin | B65D 83/0805 206/494 |
| 2003/0213705 | A1 | 11/2003 | Woog | |
| 2004/0079666 | A1 | 4/2004 | Bakx | |
| 2004/0089656 | A1 | 5/2004 | Watkins | |
| 2004/0226833 | A1 | 11/2004 | Daniel | |
| 2006/0091190 | A1 | 5/2006 | Nikolai | |
| 2007/0000794 | A1 | 1/2007 | Requena | |
| 2008/0202946 | A1 | 8/2008 | Jego | |
| 2010/0307932 | A1 * | 12/2010 | Mezzini | B65D 83/0817 206/38 |

FOREIGN PATENT DOCUMENTS

| | | |
|---|---|---|
| DE | 20 2004 004 248 | 8/2004 |
| DE | 20 2004 017 954 | 2/2005 |

(56) References Cited

FOREIGN PATENT DOCUMENTS

| | | |
|---|---|---|
| EP | 0 048 506 | 3/1982 |
| EP | 0 285 043 | 10/1988 |
| EP | 0 398 835 | 11/1990 |
| EP | 0 495 197 | 7/1992 |
| EP | 0 541 334 | 5/1993 |
| EP | 0 639 504 | 2/1995 |
| EP | 0 780 320 | 6/1996 |
| EP | 1 070 671 | 1/2001 |
| EP | 1 384 679 | 1/2004 |
| EP | 1 661 813 | 5/2006 |
| FR | 1 582 235 | 9/1969 |
| FR | 2 525 992 | 11/1983 |
| FR | 2 664 239 | 1/1992 |
| FR | 2 731 413 | 9/1996 |
| GB | 889 718 | 2/1962 |
| GB | 1 342 180 | 12/1973 |
| GB | 2 085 391 | 4/1982 |
| GB | 2 158 037 | 11/1985 |
| JP | 2004524234 | 12/2004 |
| SE | 140 388 | 5/1953 |
| WO | WO 91/05448 | 4/1991 |
| WO | WO 97/33807 | 9/1997 |
| WO | WO 98/49071 | 11/1998 |
| WO | WO 99/01356 | 1/1999 |
| WO | WO 02/40374 | 5/2002 |
| WO | WO 02/059011 | 8/2002 |
| WO | WO 02/062676 | 8/2002 |
| WO | WO 02/079048 | 10/2002 |
| WO | WO 03/016167 | 2/2003 |
| WO | WO 2005/085091 | 9/2005 |
| WO | WO 2005/095222 | 10/2005 |
| WO | WO 2006/044583 | 4/2006 |
| WO | WO 2006/108098 | 10/2006 |
| WO | WO 2007/044525 | 4/2007 |

* cited by examiner

CARTON WITH ARTICLE ENGAGEMENT FEATURES

CROSS-REFERENCE TO RELATED APPLICATIONS

This application claims the benefit of each of U.S. Provisional Patent Application No. 62/402,320, filed on Sep. 30, 2016, U.S. Provisional Patent Application No. 62/402,331, filed on Sep. 30, 2016, and U.S. Provisional Patent Application No. 62/402,332, filed on Sep. 30, 2016.

INCORPORATION BY REFERENCE

The disclosures of each of U.S. Provisional Patent Application No. 62/402,320, filed on Sep. 30, 2016, U.S. Provisional Patent Application No. 62/402,331, filed on Sep. 30, 2016, and U.S. Provisional Patent Application No. 62/402,332, filed on Sep. 30, 2016 are hereby incorporated by reference for all purposes as if presented herein in their entirety.

BACKGROUND OF THE DISCLOSURE

The present disclosure generally relates to cartons, associated blanks for forming cartons, and methods associated therewith. More specifically, the present invention relates to cartons, associated blanks for forming cartons, and associated methods with regard to blanks and cartons that have features for engaging one or more articles stored therein.

SUMMARY OF THE DISCLOSURE

According to one aspect of the disclosure, a carton for holding at least one article comprises a plurality of panels, a plurality of end flaps, and an engagement structure. The plurality of panels extends at least partially around an interior of the carton and the plurality of end flaps are respectively foldably connected to a respective panel of the plurality of panels for closing an end of the carton. The engagement structure is attached to at least one panel of the plurality of panels and is positioned for receiving the at least one article and activating the at least one article.

According to another aspect of the disclosure, a blank for forming a carton for holding at least one article comprises a plurality of panels, a plurality of end flaps, and an engagement structure. The plurality of panels are for at least partially extending at least partially around an interior of the carton formed from the blank and the plurality of end flaps are respectively foldably connected to a respective panel of the plurality of panels for closing an end of the carton formed from the blank. The engagement structure is attached to at least one panel of the plurality of panels and is positioned for receiving the at least one article and activating the at least one article in the carton formed from the blank.

According to another aspect of the disclosure, a method of forming a carton for holding at least one article comprises obtaining a blank comprising a plurality of panels, a plurality of end flaps respectively foldably connected to a respective panel of the plurality of panels, and an engagement structure attached to at least one panel of the plurality of panels. The engagement structure is positioned for receiving the at least one article and activating the at least one article. The method further comprises positioning the at least one article in the interior of the carton and folding the plurality of end flaps to form a closed end of the carton.

According to another aspect of the disclosure, a method of activating an article comprises obtaining a carton holding the article. The carton comprises a plurality of panels that extends at least partially around an interior of the carton, a plurality of end flaps respectively foldably connected to a respective panel of the plurality of panels closing an end of the carton, and an engagement structure attached to at least one panel of the plurality of panels. The method further comprises accessing the interior of the carton and removing the article, and engaging the article with the engagement structure to activate the article.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present invention generally relates to cartons, associated blanks for forming cartons, and associated methods with regard to blanks and cartons that contain one or more articles such as cleaning articles, for example, duster pads, wipes, etc. The articles can be used for cleaning surfaces, and may have a bunched and/or layered arrangement when stored in a carton. The articles can be made from materials suitable in composition for cleaning surfaces and can include, but are not limited to, non-woven layers that may include fibrous polymeric or composite materials, for example, one or more of rayon, viscose, luocell, acetate, triacetate, thermoplastic synthetic polymers including polyester, polypropylene, polyethylene, and composite fibers including cellulose pulp, cotton, hemp, jute abaca, kenaf, sabai grass, flax, esparto grass, straw, bagasse, milkweed floss fibers, and pineapple leaf fiber, or any other suitable material.

Cartons according to the present invention can accommodate articles of any shape. In this specification, the terms "lower," "bottom," "upper" and "top" indicate orientations determined in relation to fully erected and upright cartons. As described herein, cartons may be formed by multiple overlapping panels and/or end flaps. Such panels and/or end flaps may be designated in terms relative to one another, e.g., "first", "second", "third", etc., in sequential or non-sequential reference, without departing from the disclosure.

Figure 1:
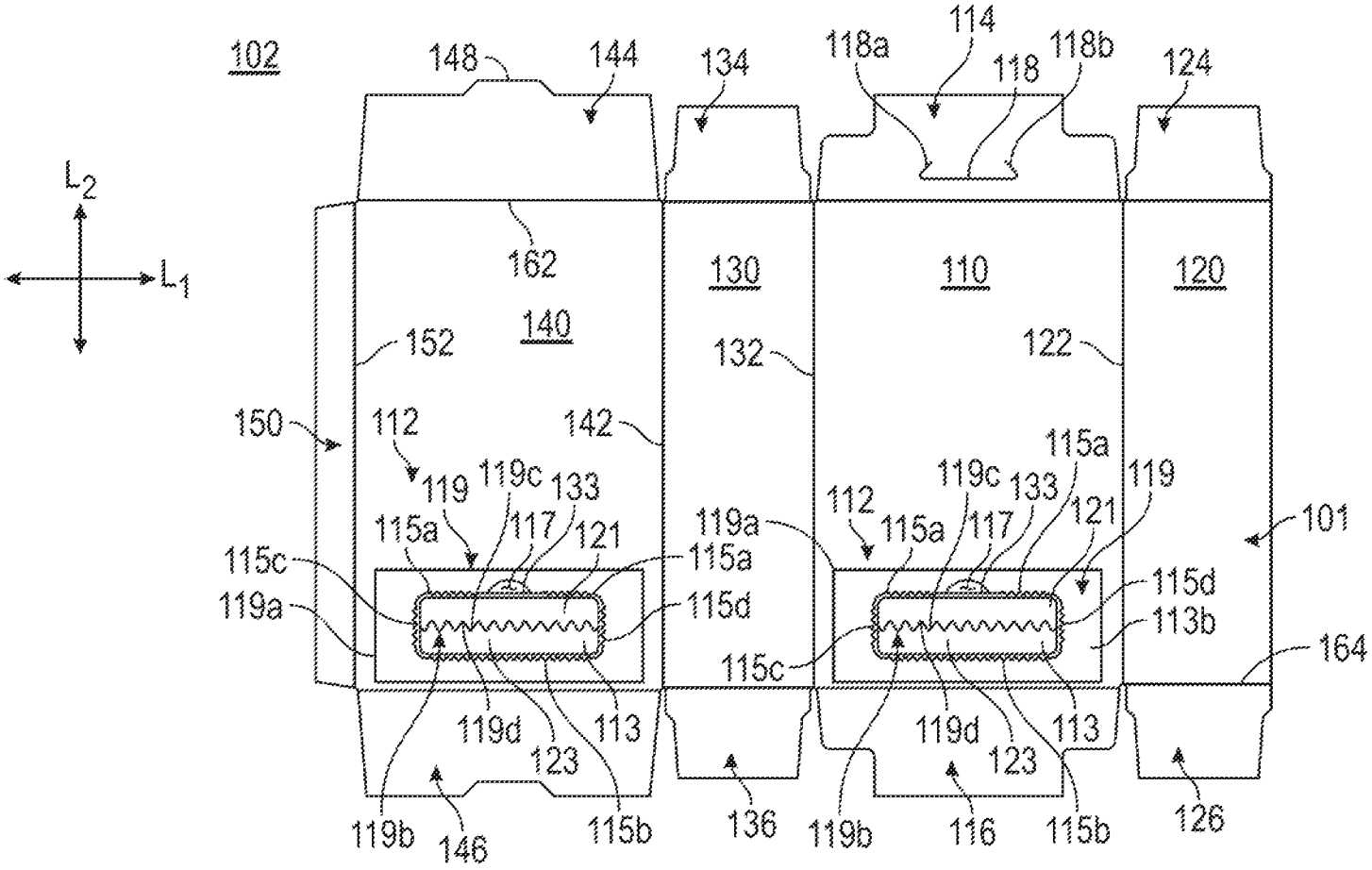
FIG. 1 is a plan view of a blank for a carton according to an exemplary embodiment of the disclosure.

FIG. 1 is a plan view of an exterior side 101 of a blank 102 that has been obtained for forming a carton 100 (FIG. 2) according to an exemplary embodiment of the disclosure. The carton 100 is for holding a plurality of articles A (FIG. 4) that have a bristled, layered, and/or feathered configuration, for example duster pads, and the carton 100 has article engagement features 112 to activate (i.e., separate, expand, fluff, and/or actuate), e.g., at least partially move one portion relative to another portion of, one or more articles A upon contact of the one or more articles A with the article engagement features 112. The carton 100 could have various other features without departing from the disclosure.

The blank 102, as shown, has a longitudinal axis L1 and a lateral axis L2. As shown in FIG. 1, the blank 102 includes a front panel 110 foldably connected to a first side panel 120 at a lateral side thereof at a fold line 122. The blank 102 includes a second side panel 130 foldably connected to an opposite lateral side of the front panel 110 at a fold line 132. A rear panel 140 is foldably connected to the second side panel 130 at a fold line 142. An attachment panel 150 may be foldably connected to the rear panel 140 at a fold line 152, as shown.

As shown, a first end flap 114 and a second end flap 116 are foldably connected to the front panel 110, a first end flap 124 and a second end flap 126 are foldably connected to the first side panel 120, a first end flap 134 and a second end flap 136 are foldably connected to the second side panel 130, and a first end flap 144 and a second end flap 146 are foldably connected to the rear panel 140. When the carton 100 is erected, the end flaps 114, 124, 134, 144 close a first end 107 (FIG. 3) of the carton 100, and the end flaps 116, 126, 136, 146 close a second end 109 (FIG. 3) of the carton 100. In accordance with alternative embodiments of the present disclosure, different flap arrangements can be used for at least partially closing the ends 107, 109 of the carton 100.

In the illustrated embodiment, the end flaps 114, 124, 134, 144 extend along a first marginal area of the blank 102, and are foldably connected to a respective panel 110, 120, 130, 140 at a first longitudinal fold line 162 that extends along the length of the blank 102. As also shown, the end flaps 116, 126, 136, 146 extend along a second marginal area of the blank 102, and are foldably connected to a respective panel 110, 120, 130, 140 at a second longitudinal fold line 164 that extends along the length of the blank 102. The longitudinal fold lines 162, 164 may be, for example, substantially straight, or offset at one or more locations to account for blank thickness and other factors.

In one embodiment, the end flap 114 includes a tear line 118 for forming a female locking feature or slot and the end flap 144 includes a protrusion 148 for forming a male locking tab. As shown, the tear line 118 can include relief portions 118*a*, 118*b*. Upon opening the carton 100, the end flaps 114, 124, 134, 144 can be folded with the end flap 144 overlapping the end flap 114 and the protrusion 148 pressed against the end flap 114 to tear the tear line 118 and allow insertion of the protrusion 148 through the tear line 118 between portions of the end flap 144 to close and/or reclose the carton 100. The end flaps 144, 114 could have other locking features or the features shown could be otherwise shaped, arranged, configured, and/or omitted without departing from the disclosure.

As shown in FIG. 1, a set of engagement features 112 are formed on each of front panel 110 and rear panel 140 of the blank 102. Each set of engagement features 112 includes an access panel 113 at least partially defined by a tear line 115. Each access panel 113 is disposed over and in face-to-face contact with a fitment 119 and an engagement opening 135 (FIG. 4), as described further herein. In one embodiment, the tear lines 115 each have a first longitudinal portion 115*a*, a second longitudinal portion 115*b*, and first and second lateral portions 115*c*, 115*d* extending between the ends of the longitudinal portions 115*a*, 115*b*. In the illustrated embodiment, the access panels 113 are generally rectangular, but the access panels 113 and the tear lines 115 could be otherwise shaped, arranged, and/or configured without departing from the disclosure. Also, the access panels 113 can be configured to remain foldably connected to the respective panels 110, 140 by replacing one or more of the portions 115*a*, 115*b*, 115*c*, 115*d* of the tear lines 115 with a fold line. As shown, the access panels 113 are spaced apart from the fold line 164 such that the access panels 113 and the engagement openings 135 are spaced apart from an end 109 of the carton 100 (FIG. 4), for example, by a distance of about 0.5 inches from the respective portions 115*b* of the tear line 115 to the fold line 164. In embodiments, the access panels 113 may be spaced a different distance away from the fold line 164.

As shown in FIG. 1, an aperture 117 in the front panel 110 and the rear panel 140 is adjacent an edge 133 of the respective access panels 113 that are collinear with the longitudinal portions 115*a* of the tear lines 115. The aperture 117 allows the edge 133 of the access panels 113 to be grasped to separate the access panels 113 from the carton 100 at the tear lines 115 and to create and/or expose the engagement openings 135 (FIG. 4) of the carton 100. In embodiments, the aperture 117 could be formed by the removal of a tab.

Still referring to FIG. 1, the respective engagement features 112 includes an engagement structure or fitment 119 attached to an interior surface of the blank 102. In one embodiment, each fitment 119 includes a base 119*a* adhesively attached to the respective front panel 110 and the rear panel 140 and a cut line 119*b* through a portion of the base 119*a*. The cut line 119*b* defines a first plurality of teeth 119*c* in a first portion 121 of the fitment 119 and a second plurality of teeth 119*d* in a second portion 123 of the fitment 119. As shown, the first plurality of teeth 119*c* can be meshed or nested with the second plurality of teeth 119*d*. In this regard, the cut line 119*b* may have a jagged, toothed, and/or zig-zag configuration, or any other configuration without departing from the disclosure.

In the illustrated embodiment, the fitments 119 are sized to be wider than the respective access panels 113 so that the respective fitments 119 extend across the lateral tear lines 115*c*, 115*d* that define the access panels 113. In embodiments, the teeth 119*c*, 119*d* could be shaped differently than illustrated, for example, irregular shaped, or replaced with alternative configurations such as spikes, barbs, or hooks, or any other configuration without departing from the disclosure. In some embodiments, the first portion 121 and the second portion 123 of the respective fitments 119 can be foldably connected to the base 119*a* of the respective fitments 119 so that the portions 121, 123 can be folded or moved when the engagement features 112 are activated. Additionally or alternatively, the cut line 119*b* that forms the teeth 119*c,* 119*d* could be a tear line without departing from the disclosure. In other embodiments, the fitments 119 could be otherwise shaped, arranged, and/or positioned without departing from the disclosure.

In one embodiment, the fitments 119 are made of a polymeric material such as a plastic material (e.g., APET or other suitable material), and may have a rigid configuration. The fitments 119 can be formed of a material other than plastic (e.g., metal, paperboard, or any other suitable material) without departing from the disclosure.

Figure 4:
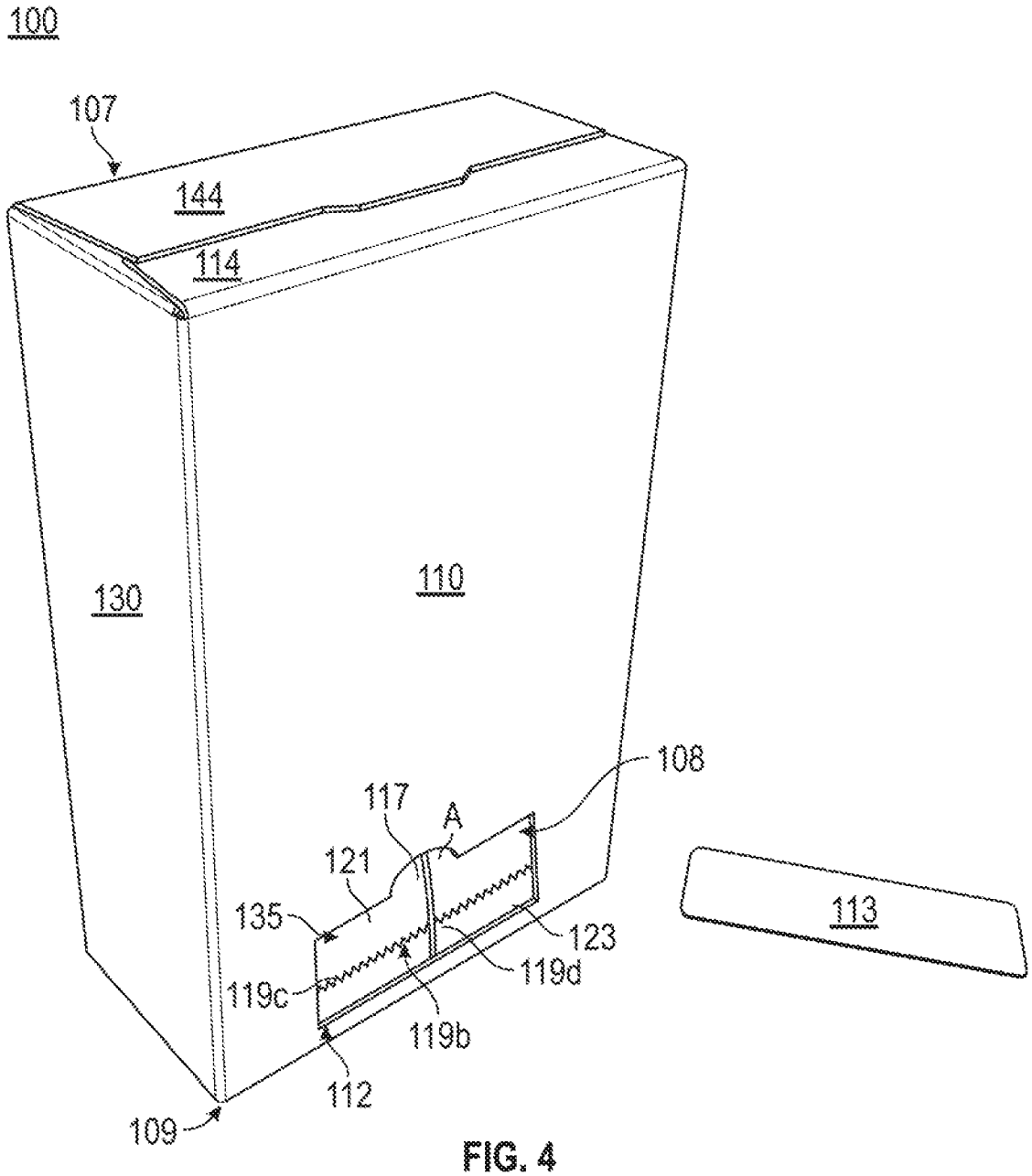
FIG. 4 is a perspective view of the carton of FIG. 3 with an access panel removed.

In embodiments, the portions 121, 123 of the respective fitments 119 containing the teeth 119*c,* 119*d* could be movably connected to the remainder of the respective fitments 119 without departing from the disclosure. The portions 121, 123 or other parts of the respective fitments 119 may incorporate one or more structures to facilitate movement of the portions 121, 123 relative to the remainder of fitments 119, for example, hinges, fold lines, or score lines, to name a few. In embodiments, the portions 121, 123 of respective fitments 119 containing the teeth 119*c,* 119*d* may have resilient properties such that the portions of respective fitments 119 tend to return to their original condition in planar abutment or otherwise aligned with the respective panels 110, 140 under a biasing force. In this regard, the portions 121, 123 of the respective fitments 119 may be configured to move inwardly and/or outwardly with respect to the respective panels 110, 140 upon engagement, for example, by one or more articles A (FIG. 4). In the illustrated embodiment, the portions 121, 123 of the respective fitments 119 include the teeth 119*c,* 119*d* at respective edges of the portions 121, 123. One of the portions 121, 123 may be removed such that only one of the respective pluralities of teeth 119*c,* 119*d* are disposed along the cut line 119*b,* or the teeth 119*c,* 119*d* can be located on a different portion of the respective fitments 119, for example, an edge of the fitments 119, without departing from the disclosure.

While the fitments 119 associated with each of the front panel 110 and rear panel 140 have been described as having substantially similar configurations, the fitments 119 may have one or more different features without departing from the disclosure.

Figure 2:
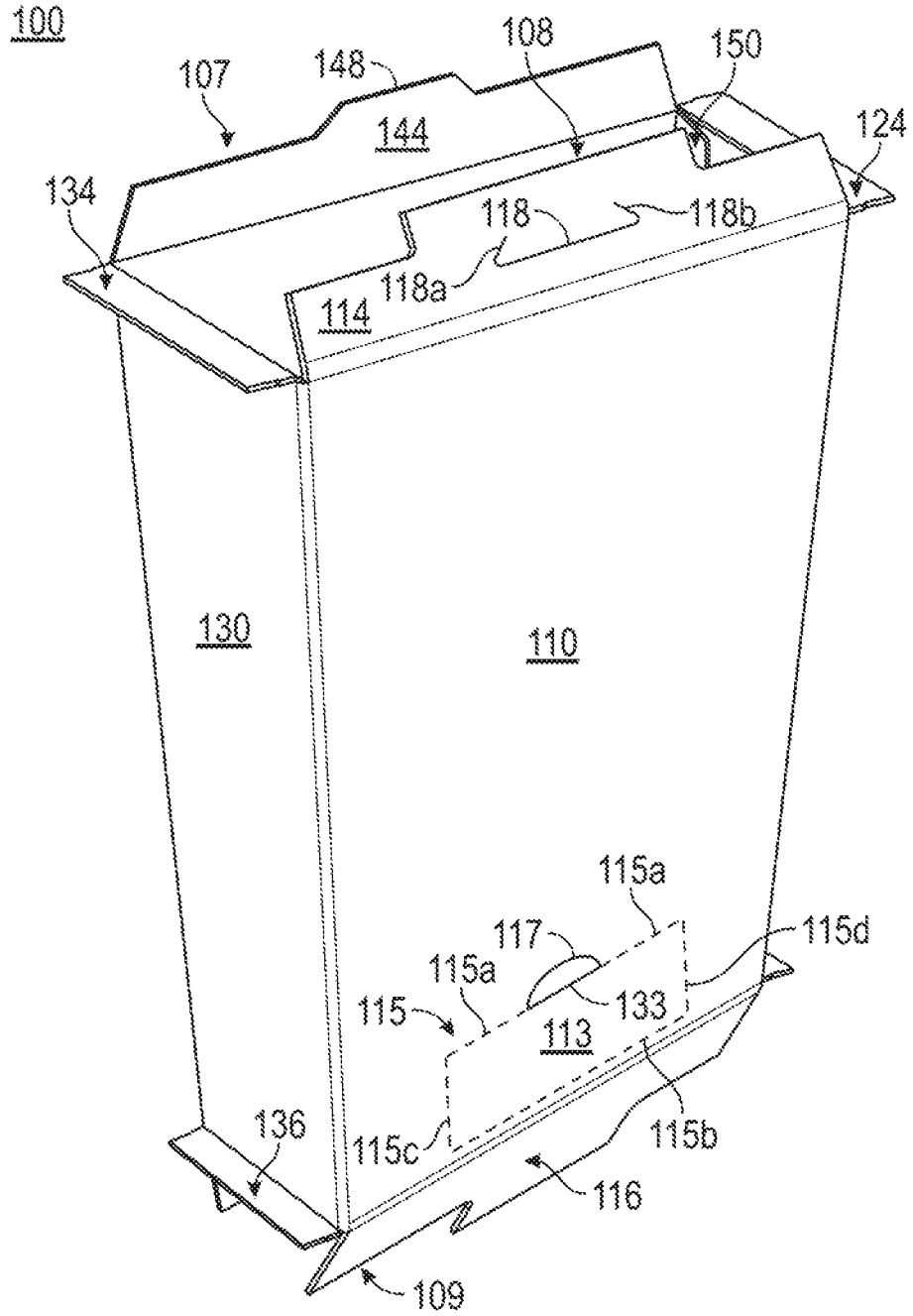
FIG. 2 is a perspective view of a carton assembled from the blank of FIG. 1 in an open configuration according to an exemplary embodiment of the disclosure.

Still referring to FIG. 1, and referring additionally to FIG. 2, a method of forming the carton 100 from the blank 102 will be described. The carton 100 is illustrated in an open or sleeve-like configuration in FIG. 2, which can be formed by folding the front panel 110, the first side panel 120, the second side panel 130, and the rear panel 140 relative to one another at the respective fold lines 122, 132, 142. The attachment panel 150 may be folded at fold line 152 and disposed in substantially face-to-face contact with an interior surface of the second side panel 130 to enclose an interior 108 of the carton 100. The attachment panel 150 may be attached to second side panel 130, for example, with an adhesive such as glue.

Figure 3:
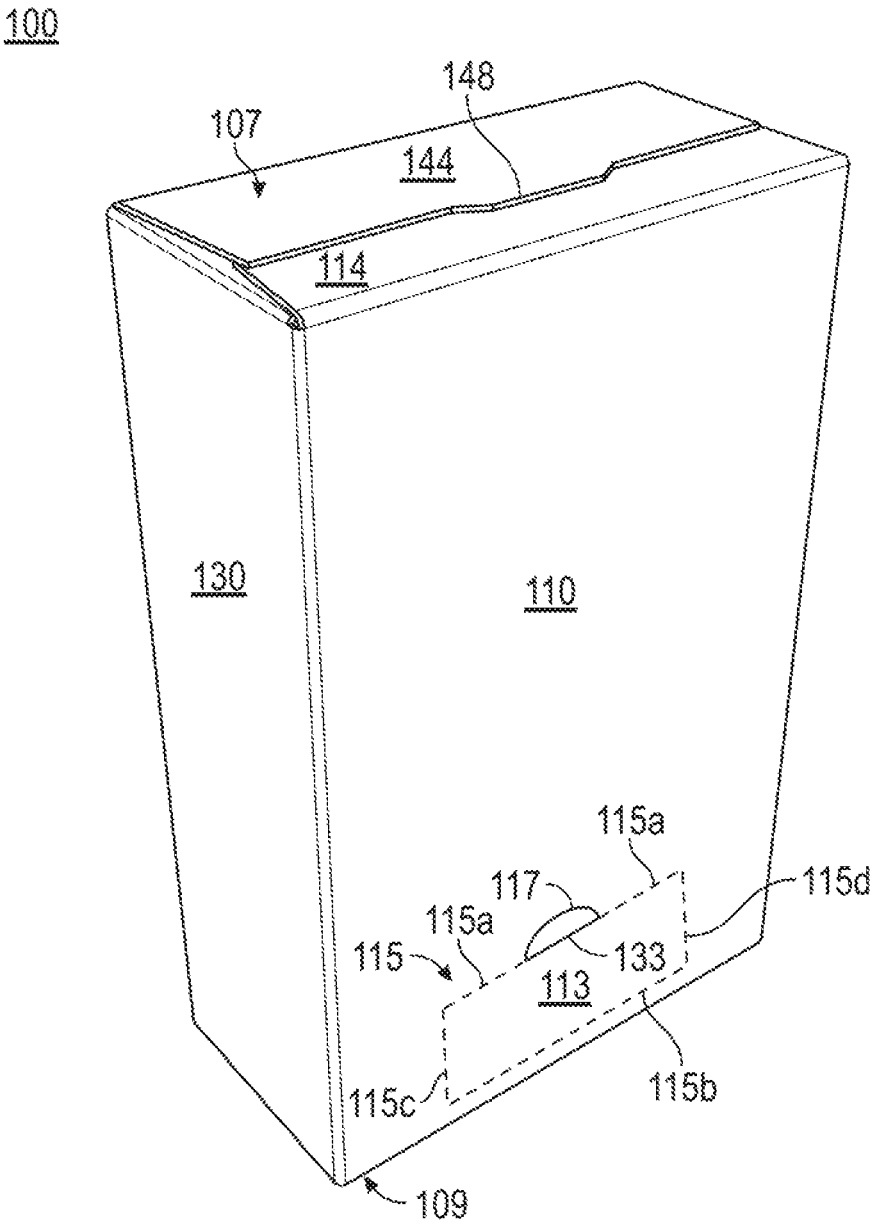
FIG. 3 is a perspective view of the carton of FIG. 2 in a closed configuration.

With additional reference to FIG. 3, the end flaps 114, 124, 134, 144 and the end flaps 116, 126, 136, 146 can be folded at the respective fold lines 162, 164 and at least partially overlapped with one another and secured in such an arrangement, for example, through an adhesive or through one or more interlocking features to close a first end 107 and an opposite second end 109 of the carton 100. In an initial closed configuration of the carton 100, the end flap 144 can be overlapped upon the end flap 114 in at least partial face-to-face contact, and can be maintained in such a configuration with an adhesive such as glue. After an initial opening of the second end 109 of the carton 100, the protrusion 148 on the end flap 144 may be at least partially inserted through the tear line 118 on the end flap 114 to provide a redo sable configuration for subsequent openings and closings of the second end 109 of the carton 100. In this regard, protrusion 148 can be selectively engaged and disengaged from the end flap 144 through the tear line 118 to allow selective opening and closing of the second end 109 of the carton 100 to provide access to the interior 108 of the carton 100.

Articles A (FIG. 4) can be placed or positioned in the carton 100 prior to closing one or both ends 107, 109 such that articles A can be disposed in the interior 108 of the carton 100. Articles A may be disposed in a stacked or other arrangement in the interior 108 of the carton 100. In this regard, the reclosable second end 109 of carton 100 allows a user to open the second end 109 to remove one or more articles A from the interior 108 of carton 100 before reclosing the second end 109.

The carton 100 has been described with end flaps 116, 126, 136, 146 forming a bottom second end 109 thereof in the interest of clarity as the following figures will be described with the carton 100 in an inverted orientation relative to FIG. 3 such that the second end 109 is a top-facing end of the carton 100. In use, the carton 100 may be used in either orientation to satisfy a user's needs.

Still referring to FIG. 1, and with additional reference to FIG. 4, a user may insert one or more of his or her fingers and/or a tool into aperture 117 to engage a portion of the access panel 113 of either or both of front panel 110 and rear panel 140. Thereafter, a user may remove the respective access panel 113 along one or more portions 115*a,* 115*b,* 115*c,* 115*d* of tear line 115 such that the engagement openings 135 into the interior 108 of the carton 100 are provided and the portion of the fitments 119 including the first and second pluralities of teeth 119*c,* 119*d* along the cut line 119*b* are exposed at the engagement openings 135 such that the cut lines 119*b* provide access to the interior 108 of the carton 100. The fitments 119 can be formed of a flexible and/or resilient material such that the pluralities of teeth 119*c,* 119*d* can move relative to one another to provide increased access to the interior 108 of the carton 100 at the cut lines 119*b.* In such an orientation of the carton 100, articles A disposed within the interior 108 of carton 100 may be urged, due to gravity, downwardly toward the end 107 of the carton and away from the teeth 119*c,* 119*d* such that a portion of the interior 108 of the carton 100 adjacent the closed end 109 is open to accommodate an article A being inserted into both fitments 119. As shown, the fitments 119 are vertically aligned in the carton 100, e.g., being positioned a substantially similar distance from the end 109 of the carton 100, so that the article A is inserted through both fitments 119 at an orientation substantially parallel to the closed end 109, but the fitments 119 could be offset to allow an article A to be inserted through both fitments at an angle relative to the closed end 109 without departing from the scope of the disclosure.

Figure 5:
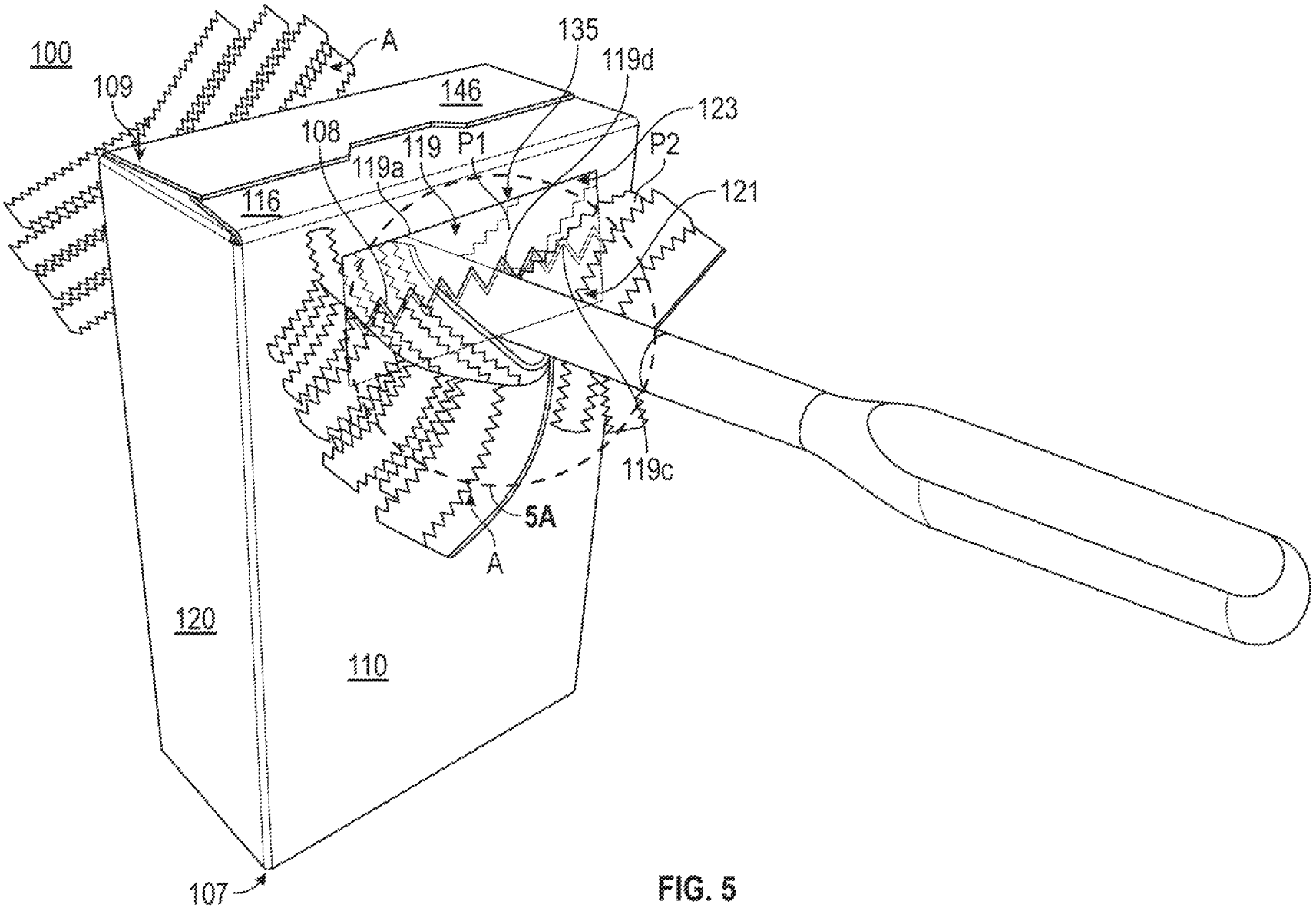
FIG. 5 is a perspective view of the carton of FIG. 4 in an inverted orientation and with an article being inserted therethrough.
Figure 5A:
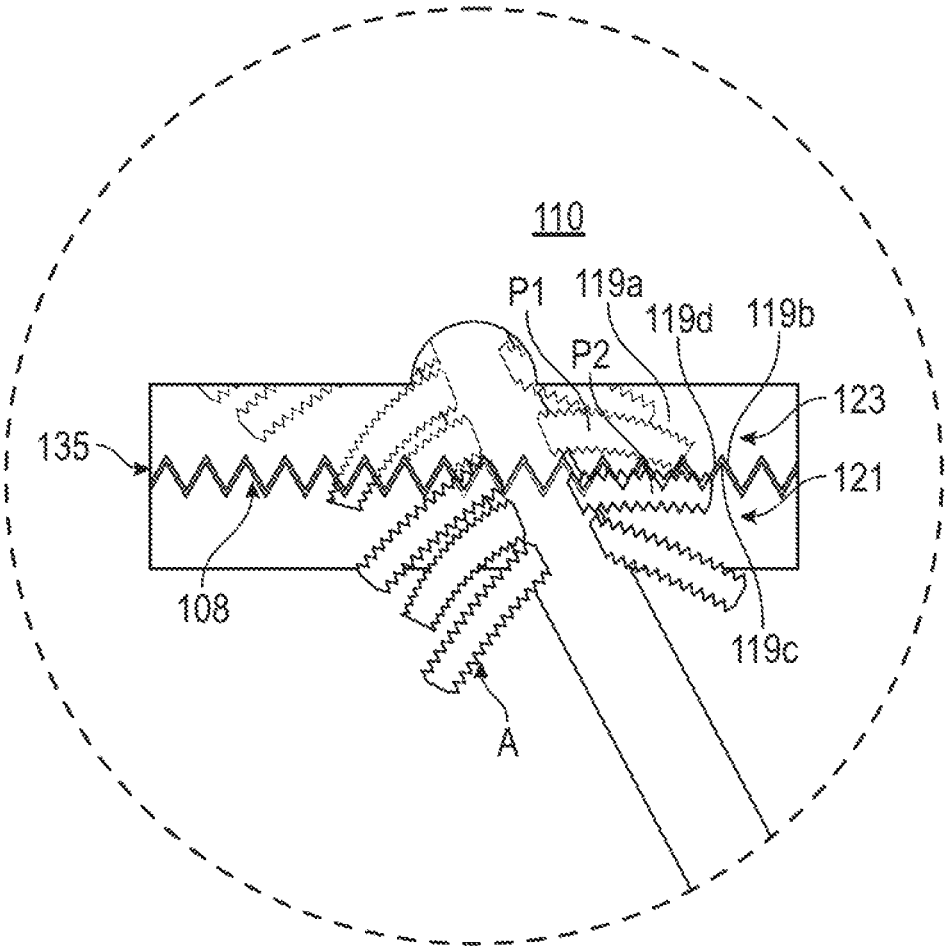
FIG. 5A is a detail view of the area identified in FIG. 5.
Figure 6:
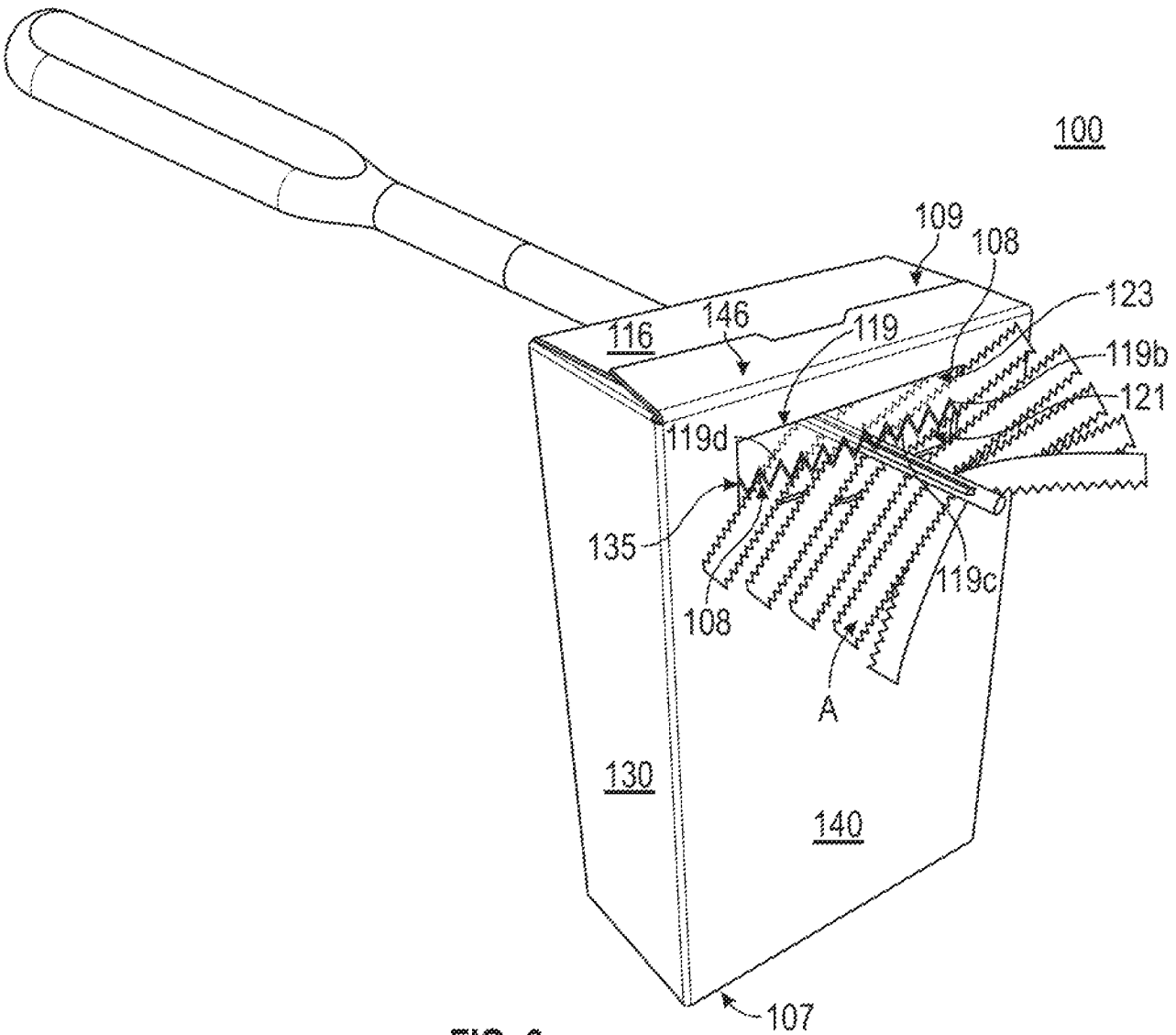
FIG. 6 is another perspective view of the carton of FIG. 5.

Referring additionally to FIGS. 5, 5A, and 6, a method of activating an article A will be described. After having obtained the carton 100 holding the articles A, a user may access the interior 108 of the carton 100, for example, by opening and optionally reclosing the second end 109 of the carton 100 as described above, and retrieve and/or remove one or more articles A from the interior 108 of the carton 100. As shown, the fitments 119 are positioned such that a user may activate one or more articles A by engaging or contacting the article with the teeth 119*c,* 119*d* by inserting one or more articles A though the cut line 119*b* of the fitment 119 between the first portion 121 and the second portion 123 of the fitment 119 and into an interior 108 of the carton 100. As shown, articles A can be disposed on a handle, rod, or other holder for grasping and manipulation by a user. One or both of the portions 121, 123 of the fitment 119 attached to the front panel 110 may flex to accommodate entry of the article A. Articles A may have a frangible, separable, and/or expandable configuration such that movement of articles A relative to the teeth 119*c*, 119*d* causes two or more portions, e.g., P1 and P2 as shown, of articles A to activate (i.e., separate, expand, fluff, and/or actuate) relative to one another. In this regard, the teeth 119*c*, 119*d* are configured to interengage one or more portions of an article A while allowing one or more other portions of article A to continue movement therealong.

As shown, a user may continue to advance one or more articles A through the cut line 119*b* between teeth 119*c*, 119*d* on the fitment 119 adhered to the front panel 110 of the carton 100 and through the interior 108 of the carton 100 such that the one or more articles passes through the cut line 119*b* between teeth 119*c*, 119*d* on the fitment 119 adhered to the rear panel 140 of the carton 100. One or both of the portions 121, 123 of the fitment 119 attached to the rear panel 140 may flex to allow at least a portion of the article A to push through the fitment 119. In this regard, one or more articles A can be advanced through and subsequently withdrawn through the teeth 119*c*, 119*d* on respective fitments 119 adhered to the front panel 110 and rear panel 140, or vice versa, of the carton 100, to maximize engagement between the one or more articles A and respective teeth 119*c*, 119*d* or other portions of the respective engagement features 112. In embodiments, a user may pass one or more articles A against the teeth 119*c*, 119*d* of one or both of the respective fitments 119 adhered to the front panel 110 and the rear panel 140 any number of times without departing from the disclosure.

The cartons of any of the illustrated or non-illustrated embodiments of the disclosure could have other features (e.g., dispenser features, handle features, reinforcement features, etc.) without departing from the disclosure. Also, the cartons could be otherwise shaped, arranged, or configured and the cartons could be configured to hold articles other than articles A without departing from the disclosure.

In general, the blanks of any of the illustrated or non-illustrated embodiments may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels that extends at least partially around an interior of the carton, the plurality of panels comprises a front panel, a rear panel, and at least one side panel;

a plurality of end flaps respectively foldably connected to a respective panel of the plurality of panels for closing an end of the carton; and a first engagement structure attached to the front panel opposite a second engagement structure attached to the rear panel, one of the first engagement structure and the second engagement structure positioned for receiving the at least one article and for at least partially activating the at least one article and the other of the first engagement structure and the second engagement structure positioned for receiving the at least one article from the one of the first engagement structure and the second engagement structure through the interior of the carton and for at least partially activating the at least one article.

2. The carton of claim 1, wherein the first engagement structure is attached to an interior surface of the front panel and the second engagement structure is attached to an interior surface of the rear panel.

3. The carton of claim 1, wherein each engagement structure comprises a polymeric material and each of the front panel and the rear panel comprises paperboard.

4. The carton of claim 1, wherein each engagement structure comprises a respective cut defining a first portion of the respective engagement structure and a second portion of the respective engagement structure.

5. The carton of claim 4, wherein the respective cut provides access to the interior of the carton and is for receiving the at least one article between the respective first portion and the respective second portion.

6. The carton of claim 1, wherein each engagement structure comprises a plurality of teeth for activating the at least one article.

7. The carton of claim 6, wherein each engagement structure comprises a cut defining a first plurality of teeth in a first portion of the respective engagement structure and a second plurality of teeth in a second portion of the respective engagement structure.

8. The carton of claim 7, wherein the respective first plurality of teeth and the respective second plurality of teeth are meshed with one another.

9. The carton of claim 1 comprising a first access panel removably connected to the front panel and in face-to-face contact with the first engagement structure and a second access panel removably connected to the rear panel and in face-to-face contact with the second engagement structure.

10. The carton of claim 9, wherein the first access panel is at least partially defined by a first tear line in the front panel and is separable from the front panel to form a first engagement opening in the front panel allowing access to the first engagement structure, and the second access panel is at least partially defined by a second tear line in the rear panel and is separable from the rear panel to form a second engagement opening in the rear panel allowing access to the second engagement structure.

11. The carton of claim 10, wherein the first engagement structure and the second engagement structure are vertically aligned in the carton.

12. The carton of claim 1, wherein the plurality of end flaps comprises a first plurality of end flaps for closing a first end of the carton and a second plurality of end flaps for closing a second end of the carton opposite of the first end, each engagement structure is positioned adjacent the second end.

13. The carton of claim 1, wherein each of the front panel and the rear panel is foldably connected to the at least one side panel.

14. The carton of claim 1, wherein at least one of the first engagement structure and the second engagement structure is comprised of a rigid material.

15. A blank for forming a carton for holding at least one article, the blank comprising:

a plurality of panels for at least partially extending around an interior of the carton formed from the blank, the plurality of panels comprising a front panel, a rear panel, and at least one side panel;

a plurality of end flaps respectively foldably connected to a respective panel of the plurality of panels for closing an end of the carton formed from the blank; and a first engagement structure attached to the front panel and a second engagement structure attached to the rear panel for being positioned opposite the first engagement structure in the carton formed from the blank, one of the first engagement structure and the second engagement structure positioned for receiving the at least one article and for at least partially activating the at least one article in the carton formed from the blank and the other of the first engagement structure and the second engagement structure positioned for receiving the at least one article from the one of the first engagement structure and the second engagement structure through the interior of the carton formed from the blank and for at least partially activating the at least one article in the carton formed from the blank.

16. The blank of claim 15, wherein the first engagement structure is attached to an interior surface of front panel and the second engagement structure is attached to an interior surface of the rear panel.

17. The blank of claim 15, wherein each engagement structure comprises a polymeric material and each of the at front panel and the rear panel comprises paperboard.

18. The blank of claim 15, wherein each engagement structure comprises a respective cut defining a first portion of the respective engagement structure and a second portion of the respective engagement structure.

19. The blank of claim 18, wherein the respective cut is for providing access to the interior of the carton formed from the blank and is for receiving the at least one article between the respective first portion and the respective second portion in the carton formed from the blank.

20. The blank of claim 15, wherein each engagement structure comprises a plurality of teeth for activating the at least one article.

21. The blank of claim 20, wherein each engagement structure comprises a respective cut defining a first plurality of teeth in a first portion of the respective engagement structure and a second plurality of teeth in a second portion of the respective engagement structure.

22. The blank of claim 15, comprising a first access panel removably connected to the front panel and in face-to-face contact with the first engagement structure and a second access panel removably connected to the rear panel and in face-to-face contact with the second engagement structure.

23. The blank of claim 22, wherein the first access panel is at least partially defined by a first tear line in the front panel and is separable from the front panel to form a first engagement opening in the front panel allowing access to the first engagement structure in the carton formed from the blank, and the second access panel is at least partially defined by a second tear line in the rear panel and is separable from the rear panel to form a second engagement opening in the rear panel allowing access to the second engagement structure in the carton formed from the blank.

24. The blank of claim 15, wherein the plurality of end flaps comprises a first plurality of end flaps for closing a first end of the carton formed from the blank and a second plurality of end flaps for closing a second end of the carton formed from the blank opposite of the first end, each engagement structure is positioned adjacent a respective end flap of the second plurality of end flaps.

25. The blank of claim 15, wherein each of the front panel and the rear panel is foldably connected to the at least one side panel.

26. The blank of claim 15, wherein at least one of the first engagement structure and the second engagement structure is comprised of a rigid material.

27. A method of forming a carton for holding at least one article, the method comprising:

obtaining a blank comprising a plurality of panels comprising a front panel, a rear panel, and at least one side panel, a plurality of end flaps respectively foldably connected to a respective panel of the plurality of panels, and a first engagement structure attached to the front panel opposite a second engagement structure attached to the rear panel;

folding the plurality of panels to at least partially extend around an interior of the carton such that one of the first engagement structure and the second engagement structure is positioned for receiving the at least one article and for at least partially activating the at least one article and the other of the first engagement structure and the second engagement structure is positioned for receiving the at least one article from the one of the first engagement structure and the second engagement structure through the interior of the carton and for at least partially activating the at least one article;

positioning the at least one article in the interior of the carton; and folding the plurality of end flaps to form a closed end of the carton.

28. The method of claim 27, wherein the first engagement structure is attached to an interior surface of the front panel and the second engagement structure is attached to an interior surface of the rear panel, each engagement structure comprises a polymeric material and each of the front panel and the rear panel comprises paperboard.

29. The method of claim 27, wherein each engagement structure comprises a cut defining a first portion of the respective engagement structure and a second portion of the respective engagement structure, the respective cut provides access to the interior of the carton and is for receiving the at least one article between the respective first portion and the respective second portion.

30. The method of claim 27, wherein the blank comprises a first access panel removably connected to the front panel and in face-to-face contact with the first engagement structure and a second access panel removably connected to the rear panel and in face-to-face contact with the second engagement structure.

31. The method of claim 30, wherein the first access panel is at least partially defined by a first tear line in the front panel and is separable from the front panel to form a first engagement opening in the front panel allowing access to the first engagement structure, and the second access panel is at least partially defined by a second tear line in the rear panel and is separable from the rear panel to form a second engagement opening in the rear panel allowing access to the second engagement structure.

32. The method of claim 31, wherein the first engagement structure and the second engagement structure are vertically aligned in the carton.

33. The method of claim 27, wherein the plurality of end flaps comprises a first plurality of end flaps and a second plurality of end flaps, the folding the plurality of end flaps comprises folding the first plurality of end flaps to close a first end of the carton and folding the second plurality of end flaps to close a second end of the carton, the method comprises positioning each engagement structure adjacent the second end.

34. A method of activating an article, the method comprises:

obtaining a carton holding the article, the carton comprising a plurality of panels that extends at least partially around an interior of the carton, the plurality of panels comprising a front panel, a rear panel, and at least one side panel, a plurality of end flaps respectively foldably connected to a respective panel of the plurality of panels closing an end of the carton, a first engagement structure attached to the front panel opposite a second engagement structure attached to the rear panel;

accessing the interior of the carton and removing the article; and engaging the article with the one of the first engagement structure and the second engagement structure; and engaging the article with the other of the first engagement structure and the second engagement structure through the interior of the carton.

35. The method of claim 34, wherein each engagement structure comprises a cut defining a first portion of the respective engagement structure and a second portion of the respective engagement structure, the engaging the article with the one of the first engagement structure and the second engagement structure comprises inserting the article through an opening at the respective cut so that the article is received between the respective first portion and the respective second portion.

36. The method of claim 35, wherein the respective cut defines a first plurality of teeth in the first portion of the respective engagement structure and a second plurality of teeth in the second portion of the respective engagement structure.

37. The method of claim 34, wherein the carton comprises a first access panel removably connected to the front panel and in face-to-face contact with the first engagement structure and a second access panel removably connected to the rear panel and in face-to-face contact with the second engagement structure.

38. The method of claim 37, wherein the first access panel is at least partially defined by a first tear line in the front panel and the second access panel is at least partially defined by a second tear line in the rear panel, the method comprises separating the first access panel from the front panel at the first tear line to form a first engagement opening allowing access to the first engagement structure and separating the second access panel from the rear panel at the second tear line to form a second engagement opening allowing access to the second engagement structure.

39. The method of claim 38, wherein the engaging the article with the one of the first engagement structure and the second engagement structure comprises inserting the article through one of the first engagement opening and the second engagement opening and engaging the respective engagement structure and the engaging the article with the other of the first engagement structure and the second engagement structure comprises inserting the article through the other of the first engagement opening and the second engagement opening and engaging the respective engagement structure.

40. The method of claim 39, wherein the first engagement structure and the second engagement structure are vertically aligned in the carton.

* * * * *